US008523052B2

(12) United States Patent
Moore

(10) Patent No.: US 8,523,052 B2
(45) Date of Patent: Sep. 3, 2013

(54) VISUALIZING AND AUDITING ELECTIONS AND ELECTION RESULTS

(75) Inventor: Larry Moore, Boston, MA (US)

(73) Assignee: Clear Ballot Group, Boston, MA (US)

( * ) Notice: Subject to any disclaimer, the term of this patent is extended or adjusted under 35 U.S.C. 154(b) by 130 days.

(21) Appl. No.: 13/116,874

(22) Filed: May 26, 2011

(65) Prior Publication Data

US 2012/0168502 A1 Jul. 5, 2012

Related U.S. Application Data

(60) Provisional application No. 61/428,153, filed on Dec. 29, 2010.

(51) Int. Cl.
*G07C 13/00* (2006.01)

(52) U.S. Cl.
USPC ..... 235/51

(58) Field of Classification Search
USPC ..... 235/51–57
See application file for complete search history.

(56) References Cited

U.S. PATENT DOCUMENTS 6,942,142 B2 * 9/2005 Barmettler et al. ..... 235/51
7,406,480 B2 7/2008 Seibel et al.
2005/0247783 A1 11/2005 Poulos et al.
2007/0192176 A1 8/2007 Onischuk
2009/0032591 A1 2/2009 Cordery et al.
2009/0099908 A1 4/2009 Seibel et al.

FOREIGN PATENT DOCUMENTS

WO 02052371 7/2002

OTHER PUBLICATIONS

International Search Report and Written Opinion from corresponding PCT Patent Application No. PCT/US2011/067742, Sep. 12, 2012, 8 pages.

* cited by examiner

*Primary Examiner* — Christle Marshall
(74) *Attorney, Agent, or Firm* — Proskauer Rose LLP

(57) ABSTRACT

Disclosed are methods, systems, and computer program products for visualizing results of elections. A set of ballots, each including one or more areas for expression of intent, are received and analyzed with a computerized image analysis tool. The image analysis tool provides a score associated with the areas for expression of intent for one or more of the set of ballots. The analyzed areas are displayed on an image-display device according to a predetermined criterion.

28 Claims, 11 Drawing Sheets

VISUALIZING AND AUDITING ELECTIONS AND ELECTION RESULTS

CROSS-REFERENCE TO RELATED APPLICATIONS

The application claims priority to and the benefit of U.S. Patent Application No. 61/428,153 titled "Visualizing and Auditing Elections and Election Results," by Moore et al. filed Dec. 29, 2010, the entire contents of which are hereby incorporated by reference.

TECHNICAL FIELD

The description generally relates to visualizing and auditing elections and election results.

BACKGROUND

Generally, representative democracies are based on the free election of individuals to representative office and/or electoral questions on laws or regulations (e.g., ballot referenda and the like). Faith in elections is often considered fundamental to the function of free societies. As the size of communities and registered voters has grown, local election departments have transitioned from hand-counted elections to machine-counted elections. In a machine-counted election, vote readers interpret marked ballots (e.g., voter-marked ballots) to determine whether the ballot indicates a voter's intended vote. The vote readers count the number of marked ballots and communicate with a vote tabulator that accumulates the vote totals from the vote readers. The accumulated vote totals are used to determine the election winner(s). Each vote reader and/or vote tabulator is programmed to read and/or analyze ballots to discern voter intent. The programming is generally proprietary to the company making the reader/tabulator and is thus susceptible to fears about errors or hacking resulting in erroneous or fraudulent election results.

An election department typically certifies an election result based, at least in part, on the accumulated vote totals from the vote tabulator. If an election is contested, a recount (either machine or manual) normally occurs prior to election certification. After certification, a party dissatisfied with an election result is left without recourse. During a recount, ballots are manually examined and evaluated to discern voter intent. Voter intent is evaluated based on markings on the marked ballot, typically in areas on the ballot that are designated for voter intent such as markable ovals. Additionally, voter intent can be discerned based on a particular marking in the context of other markings on the ballot for other elections.

Typically, an election recount is a laborious, time-intensive, and expensive process. As a prominent example, the recount in the 2000 presidential election proceedings in Florida took approximately thirty-six days. More recently, in the 2008 senatorial recount proceedings in Minnesota took approximately eight months. These delays led to uncertainty and expense while the winner of the election was in question. Another concern is a situation in which an error in vote reading or tabulating is not determined or known, in which case a recount that might otherwise be implemented before certification is not effected, possibly resulting in the person receiving the most actual votes not taking office or a question that garnered enough actual votes to pass not passing (or vice versa).

Because of the human element in a voter marking a ballot, the vote reader must make certain determinations about whether a marking constitutes a vote (sometimes called an adjudicated vote). The vote reader can also determine whether a marking constitutes a non-vote, an over-vote (i.e., more votes than the election rules permit for that election), and an under-vote (i.e., fewer votes than the election rules permit for that election). The vote reader may miss a marking that constitutes a vote (e.g., referred to as uncaptured voter intent) or a marginal vote (e.g., a marking that, by itself, does not indicate intent but, in the context of the other markings on the ballot can be used to infer intent).

Additionally, each election department or district is often responsible for administering its own elections, including generation or printing of ballots, counting ballots, and certifying the counted votes. Because many elections are local or district- or precinct-specific, ballots tend to be unique. Differences in ballots and ballot types make universal auditing solutions difficult to implement economically.

SUMMARY

Therefore, there is a need for tools to assist those auditing elections and doing so in an automatable, repeatable, and verifiable way to engender trust in the election and/or audit results. There is a need for tools to prepare ballots, which constitute a large data set of uniquely-identified data, for analysis and presentation.

The concepts described herein address the problem by providing tools for quickly and intuitively organizing and reviewing or presenting for review a large amount of data collected from individual ballots that vary precinct-by-precinct or district-by-district. The techniques described here allow for faster, more accurate, and verifiable election recounts and support for the decision to declare an election recount. Additionally, the techniques allow for testing, auditing, and analysis of elections independent of an official election department, thereby facilitating independent review and leading to increased confidence in any particular election and the ballot-counting process in general.

In particular, described here are methods, systems, and computer program products for visualizing an election, for auditing election results and providing assistance in a recount. The techniques involve computerized image analysis of ballots, either for visualization or generating and validating a ballot definition file used to audit an election. Information associated with markings is extracted according to the image analysis process, associated, and aggregated for presentation in a logical way via, for example, a user interface for visualization. The data associated with the marking (e.g., ballot, election, physical location, etc.) are stored and can be easily called up in response to selection via the user interface.

Information is also extracted from a set of blank ballots to generate a ballot definition file, based on image analysis of the blank ballots or ballot styles. The ballot definition file can be used for a variety of purposes, e.g., generating machine-marked ballots for validation, for printing ballots for pre-election testing or actual election administration, and for evaluating and/or tabulating voter-marked ballots in support of auditing the election.

In one aspect, there is a method for displaying information associated with a set of ballots including one or more areas for expression of intent (e.g., voter intent). The method involves analyzing, with a computerized image analysis tool, the areas for expression of intent on the set of ballots. The image analysis tool provides a score associated with the areas for expression of intent for one or more of the set of ballots. The method also involves displaying the analyzed areas on an image-display device according to a predetermined criterion. In some embodiments, the analyzed areas can be an actual marking made as an expression of intent, or a proxy marking that represents the expression of intent made on a ballot.

In some embodiments, the method involves receiving the set of ballots. The method can involve associating an area for expression of intent with a ballot on which the area appears and, in response to selection of at least one of the displayed areas, displaying the ballot associated with the selected area. The set of ballots can include paper ballots or computerized images of paper ballots. The method can, in some implementations, involve associating a location of a physical ballot with the corresponding image of the ballot and displaying the location of the physical ballot (e.g., for quick identification and/or location and subsequent inspection). In some embodiments, the method involves generating computerized images based on a corresponding set of paper ballots.

The areas for expression of voter intent can include a marking indicative of voter intent. Some implementations feature the predetermined criterion being associated with the score. The score can be based on a density (or density value) of a marking in an area for expression of intent. In some embodiments, the predetermined criterion is associated with a characteristic of an election. Exemplary characteristics include at least one of a voter group (e.g. absentee, early, provisional, overseas or Election Day voters), a race, a choice, a box-ID, a precinct, a district, or any combination of these. The predetermined criterion can be associated with a characteristic of a vote. Exemplary characteristics include at least one of an adjudicated vote, a marginal vote, an undervote, an overvote, an indication of uncaptured voter intent, a non-vote, or any combination of these. Displaying can involve grouping the one or more areas based on the characteristic of the vote or ballot associated with the respective one or more areas. The grouped areas can, in turn, be sorted according to a sorting criterion (e.g., descending by density score).

In some embodiments, displaying involves sorting the one or more areas for expression of intent into one or more categories based on the score for each area. The method can involve determining the number of areas in each category and/or determining whether a marking in an area constitutes a vote. Some implementations involve obscuring or not displaying a race associated with the area for expression of intent (e.g., to anonymize the election or candidate names).

Displaying, in some implementations, involves displaying the one or more areas sequentially based on the score associated with each area. In response to user-selection of an area, the method can involve displaying information associated with the area. Examples of information displayed in these embodiments include the area, a value indicative of the number of areas with scores greater than that of the user-selected area, the score associated with the area, or any combination thereof. The area for expression of intent can include at least one of a vote target or a contest zone. A vote target can be, for example, a fillable oval or two markings connectable by a hand-drawn line representing a vote, and a contest zone can be, for example, a box bounding the vote target (or a plurality of vote targets constituting an election). In some implementations the location of a vote target is represented by x-y coordinates in a pixel reference frame of the center of the vote target. The location of a contest zone can be identified by, for example, coordinates of corners (e.g., top-left and lower-right) of the contest zone.

Some embodiments feature an interface associated with an area for expression of intent that is configured to receive user-supplied information. Examples of such interfaces include at least one of a user-fillable field or a set of user-selectable choices or both. The method can involve updating a characteristic associated with the area for expression of intent based on the user-supplied information. For example, the user-supplied information can include at least one of a decision affecting the characteristic, a reason for the decision or both. The method can further involve generating and/or displaying a decision log based on the user-supplied information. Exemplary decision logs includes at least one of a ballot number associated with the area, the decision, the reason, a number of ballots associated with the decision, a number of ballots associated with the reason, or any combination of these.

In another aspect, there is a computer program product that is tangibly embodied in a non-transitory computer-readable storage medium that contains instructions operable to cause data processing apparatus to receive a set of ballots, each including one or more areas for expressions of intent. The instructions are also operable to cause data processing apparatus to analyze, with a computerized image analysis tool, the areas for expression of intent on the set of ballots. The image analysis tool provides a score associated with the areas for expression of intent for one or more of the set of ballots. The instructions are also operable to cause data processing apparatus to display the analyzed areas on an image-display device according to a predetermined criterion.

Another aspect features a computerized system for facilitating auditing an election. The system includes a user interface in communication with a data processor. The data processor includes an image analysis module operable to analyze one or more areas for expression of intent on a received set of ballots. The image analysis module provides a score associated with the areas for expression of intent for one or more of the set of ballots. The data processor also includes a sorting module in communication with the user interface for arranging the analyzed areas according to a predetermined criterion. The system also includes an interface in communication with the sorting module operable to communicate the arranged analyzed areas to a display device for display according to the predetermined criterion.

Yet another aspect features a method. The method involves receiving a computer-readable image of a ballot and analyzing the image of the ballot with a computerized image analysis tool to generate a ballot definition file associated with the ballot. The method also involves validating the ballot definition file.

In some embodiments, validating the ballot definition file involves generating a set of marked ballots based on a predetermined voting pattern and the ballot definition file and processing the set of marked ballots with a vote tabulator and the ballot definition file to provide a simulated election outcome based on the set of marked ballots. Validating can also involve comparing a predicted election outcome based on the predetermined voting pattern and the simulated election outcome. Generating the set of marked ballots can, in some implementations, involve machine-marking the ballots based on the ballot-definition file. Generating the set of marked ballots can involve at least one of not voting, voting, overvoting, undervoting or a combination of these.

Some embodiments involve generating a first statement of votes cast associated with the predicted election outcome and a second statement of votes cast associated with the simulated election outcome. Comparing the predicted election outcome with the simulated election outcome involves, in some instances, comparing the first and second statements of votes cast. Comparing the first and second statements of votes cast can involve comparing a set of match points from the predicted election and a set of match points from the simulated election.

In some arrangements, the method further involves processing a set of voter-marked ballots with a first vote tabulator and the ballot definition file to determine a predicted election outcome, receiving an actual election outcome determined by a second vote tabulator processing the set of voter-marked ballots, and comparing the predicted election outcome and the actual election outcome. Comparing the predicted election outcome with the actual election outcome involves comparing a first statement of votes cast associated with the predicted election outcome and generated by the first vote tabulator and a second statement of votes cast associated with the actual election outcome and generated by the second vote tabulator. Comparing the first and second statements of votes cast involves comparing a set of match points from the predicted election and a set of match points from the actual election.

The generated ballot definition file can be based on the ballot style of the received ballot. Analyzing the image of the ballot involves, for example, determining a location of a contest zone, a vote target, or both, determining election information from the image, and associating at least one of a race name, a choice name, a voting rule, or any combination of these with the contest zone, the vote target, or both. The election information includes at least one of a precinct, a district, a jurisdiction name, an election date, or any combination of these. The method can also involve associating a ballot-style identifier and a ballot-side with the analyzed ballot. Some implementations of the method involve associating a location of a vote target with a timing mark on the ballot. The set of marked ballots can include voter-marked ballots.

Another aspect features a computer program product tangibly embodied in a non-transitory computer-readable storage medium containing instructions operable to cause data processing apparatus to receive a computer-readable image of a ballot, analyze the image of the ballot with a computerized image analysis tool to generate a ballot definition file associated with the ballot and validate the ballot definition file.

In some embodiments, the instructions operable to validate the ballot definition file include instructions operable to cause data processing apparatus to generate a set of marked ballots based on a predetermined voting pattern and the ballot definition file, process the set of marked ballots with a vote tabulator and the ballot definition file to provide a simulated election outcome based on the set of marked ballots and compare a predicted election outcome based on the predetermined voting pattern and the simulated election outcome. The computer program product can also include instructions operable to cause data processing apparatus to process a set of voter-marked ballots with a first vote tabulator and the ballot definition file to determine a predicted election outcome, receive an actual election outcome determined by a second vote tabulator processing the set of voter-marked ballots and compare the predicted election outcome and the actual election outcome.

In another aspect, there is a system for assessing an election result. The system includes an input module to receive a computer-readable image of a ballot and an image analysis module configured to analyze the image of the ballot. The system includes a file-generation module in communication with the image analysis module to generate a ballot-definition file based on an output of the image analysis module and a file validation module to validate the ballot definition file. In some embodiments, the system includes an interface to a vote tabulator for communicating the generated ballot definition file to the vote tabulator to facilitate processing a set of machine-marked ballots, voter-marked ballots, or both.

In some implementations, any of the above aspects can include any (or all) of the above-recited features.

These and other features will be more fully understood by reference to the following description and drawings, which are illustrative and not necessarily to scale.

DETAILED DESCRIPTION

Figure 1:
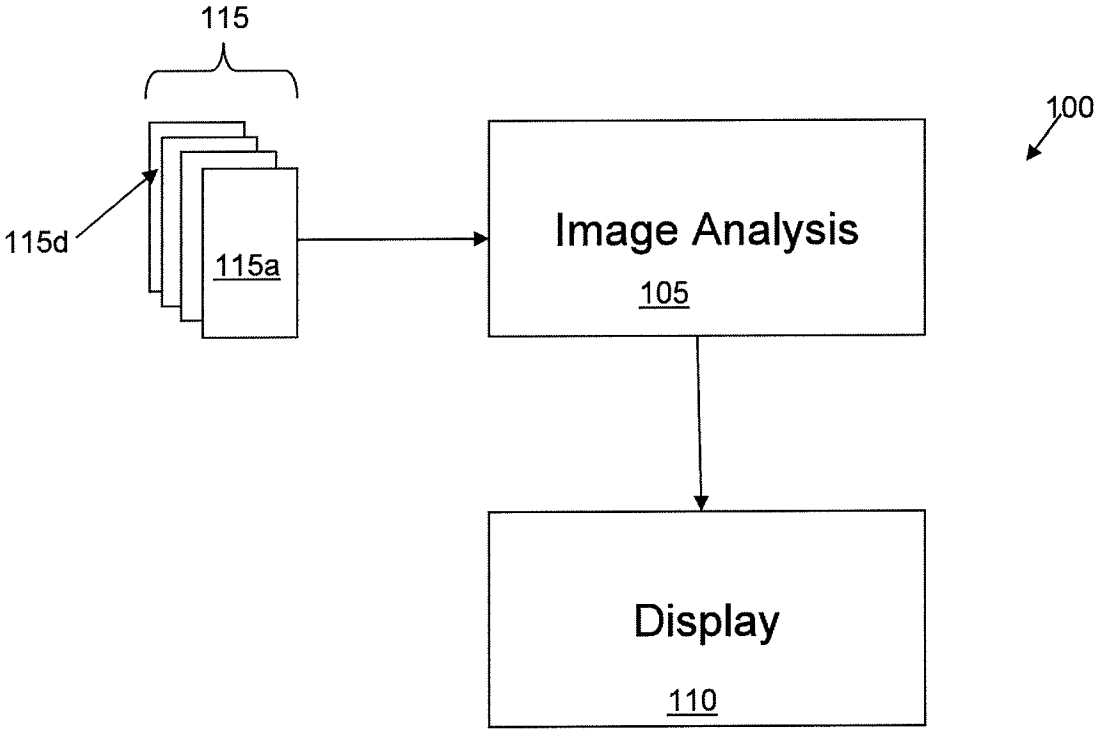
FIG. 1 is a block diagram of a system for visualizing an election.

FIG. 1 is a block diagram of a system 100 for visualizing an election. The system 100 includes an image analysis tool 105 and a display 110 in communication with the image analysis tool 105. The image analysis tool 105 can be hardware-based or software-based and in communication with a computer processor (not shown), a computer memory (not shown), and/or a communication bus (not shown). The image analysis tool 105 receives as input a set of ballots 115. The set of ballots 115 includes individual voter-marked ballots 115*a*-115*d*.

The set of ballots 115 can be either paper ballots or images of paper ballots. The images of paper ballots can be, for example, in PDF or JPEG format. In embodiments in which the set of ballots 115 are paper ballots, a ballot-imaging tool (not shown) prepares images of the paper ballots, e.g., in PDF or JPEG format, by scanning and/or processing the paper ballots. In some embodiments, the ballot images are created or prepared contemporaneously when the ballots are scanned to record a voter's votes, rather than being batch-scanned after the paper ballots are collected. For example, an imaging sub-routine associated with the ballot scanner or vote reader can be used to prepare the ballot image, and the images can be collected from the ballot scanners or vote readers for visualization. As used herein, a ballot refers to an image of a paper ballot unless otherwise indicated. The image analysis tool 105 evaluates each individual voter-marked ballot 115*a*-115*d*, as discussed in more detail below. The image analysis tool 105 can evaluate, group, sort, or order the voter-marked ballots 115*a*-115*d* (or portions thereof) according to a predetermined evaluation, grouping, sorting, or ordering criterion (or criteria).

In some embodiments, the image analysis tool 105 evaluates an individual choice on each voter-marked ballot 115*a*-115*d* and groups, sorts, or orders the set of ballots 115 on an individual choice basis. Generally, an election refers to the set of contests within an election jurisdiction (e.g. county). Contests are comprised of a set of choices as, for example between candidates or between referendum questions. A contest is generally characterized at least by a name (e.g., presidential, senatorial, etc.), the selectable options (e.g., candidates or decisions) and the voting rules associated with the options (e.g., "vote for only one," "vote for no more than two," etc.).

Figure 2:
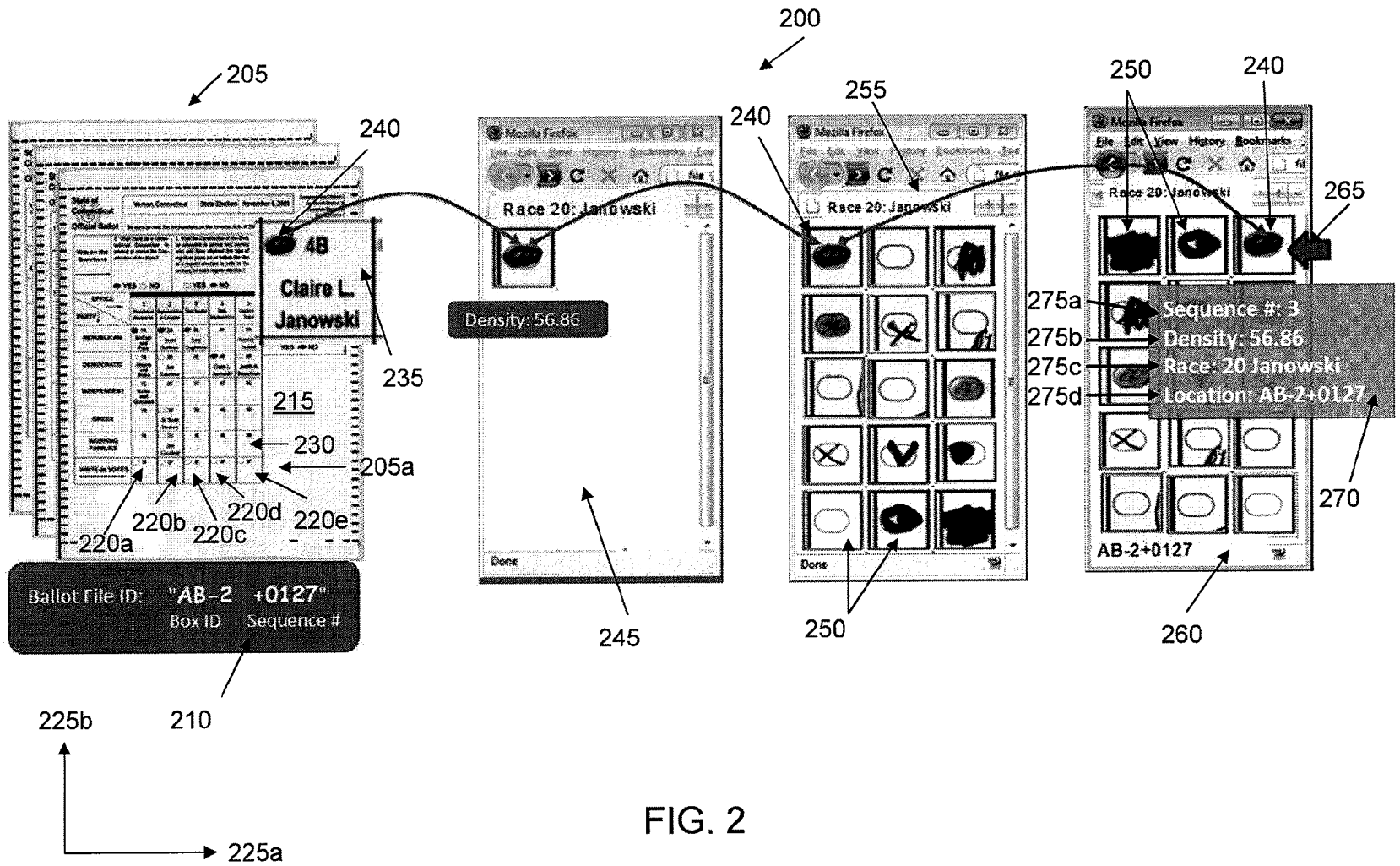
FIG. 2 is a flow diagram illustrating an exemplary process for visualizing an election.

FIG. 2 is a flow diagram illustrating an exemplary process 200 for visualizing the votes for a choice ("Claire L. Janowski) within a contest ("State Representative"). The process 200 begins with a set of voter-marked ballots 205. The set of voter-marked ballots 205 includes ballot 205*a*. The ballot 205*a* can be a paper ballot or an image of a paper ballot. The ballot 205*a* is associated with information 210 related to the paper ballot corresponding to the image of ballot 205*a*. The information 210 is referred to as the "Ballot File ID" in FIG. 2 and includes "Box ID" and "Sequence #" information. The computer file name of the ballot image is derived by appending the image type to the Ballot File ID, for example AB-2+0127.bmp. The Box ID associated with the ballot 205*a* is "AB-2," and the Sequence # associated with the ballot 205*a* is +0127 indicating the paper ballot associated with image 205*a* is stored in the physical box of ballots labeled AB-2 in position 127 counted from the front of the box. The information 210 allows the paper ballot to be quickly identified, located, and consulted, if necessary, upon review of the ballot 205*a* revealing manual inspection or analysis is required or desired.

The ballot 205*a* includes an area 215 that includes five races 220*a*-220*e*. The horizontal axis 225*a* of the area 215 represents the office and the vertical axis 225*b* represents the party of the candidates. The individual boxes 230 in area 215 are or contain areas for indication of voter intent. As illustrated, a box 235 containing a vote target 240 (e.g., a marked oval) is called out from the area 215. The vote target 240 is the area on the ballot 205*a* in which a voter can provide an indicia of intent, e.g., by marking with a marking utensil such as a pencil, pen, or marker. The box 235 represents a vote for the Democratic candidate Claire L. Janowski running in race 220*d* (State Representative). The race 220*d* is identified as "Race 20" on the ballot 205*a*.

An image analysis tool (not shown), such as, e.g., the image analysis tool 105 of FIG. 1, evaluates the ballot 205*a*. In particular, the image analysis tool extracts the vote target 240 from the ballot 205*a* and can display the extracted vote target 240 in a user interface 245. The image analysis tool calculates a density value for each of the boxes 230 in the area 215 and each of the elections (not indicated) on the ballot 205*a*. With respect to the race 220*d*, the image analysis tool determined that the density associated with the vote target 240 in box 235 has a value of 56.86, as shown in the user interface 245. The density typically indicates the degree of confidence that the image analysis tool assigns to a given vote target (e.g., higher density scores indicate higher confidence that the voter has expressed their intent unambiguously). The image analysis tool calculates density of the vote target (e.g. a rectangular box (not shown) that bounds the vote target 240) by measuring the percent coverage and darkness of the mark in the vote target 240. Thus, for example, a vote target 240 that is completely filled in with a light pencil will register a lower density than another vote target 240 completely filled in with a black, felt-tip pen. The rectangular box 235 is sometimes called a "contest zone." In some embodiments, the image analysis tool can find and/or evaluate markings outside the vote target 240 but within the contest zone 235.

After evaluating the ballot 205*a*, the image analysis tool extracts vote targets 250 associated with the same choice (e.g., 235) from the other ballots in the set of ballots 205. The extracted vote targets 250 associated with choice 235 are displayed in a user interface window 255 along with the extracted vote target 240. In some embodiments a proxy mark is displayed instead of the actual mark made by the voter. When a proxy mark is shown, a user can click on the proxy mark and the actual ballot, showing the actual mark made by the voter, can be viewed. The extracted vote targets 240, 250 as shown in user interface window 255 are generally organized by the order in which the vote targets were extracted (e.g., in the order in which the images of the set of ballots were analyzed). Typically, after all the vote targets 240, 250 have been extracted, the vote targets 240, 250 can be sorted or organized, e.g., as shown in the user interface window 260. In some embodiments, the vote targets 240, 250 are sorted in descending order according to the density associated with the vote target 240, 250, as calculated or determined by the image analysis tool.

For example, the user interface window 260 includes the vote target 240 associated with the ballot 205*a*, as well as other extracted vote targets 250. The user interface 260 provides a quick and intuitive view of an election (e.g., the votes cast for Claire L. Janowski in race 220*d*). The user interface window 260 is, in some embodiments, interactive. For example, in response to a user selection (e.g., by hovering a pointing device or element 265 over the portion of the user interface window 260 coincident with the extracted vote target 240), an information field 270 is displayed. In some embodiments, the candidate names are not presented or are obscured or covered to allow the votes to be evaluated without knowledge of how a change or decision will benefit or detract from a candidate's vote total.

As illustrated, the information field 270 includes four subfields 275*a*-275*d*. The subfield 275*a* identifies the "Sequence #" of the vote target 240 among the set of extracted vote targets 250 shown in the user interface window 260. As illustrated, the vote target 240 has a value for "Sequence #" of 3, indicating the vote target 240 has the third-highest score in user interface window 260 (e.g., or the third-highest density score). The subfield 275*b* identifies the density associated with the vote target 240, as calculated or determined by the image analysis tool. The subfield 275*c* contains an indicator of the "Race." The value of the "Race" subfield 275*c* as illustrated is "20 Janowski" indicating the user interface window 260 is associated with the votes for Claire L. Janowski in race 220*d*. The subfield 275*d* contains an indicator of the "Location." The value of the "Location" subfield 275*d* provides an indication of the physical location of the ballot 205*a* containing the vote target 240, in this case at position 127 in the box labeled AB-2. Thus, if the vote target 240 is of interest, the physical location of the paper ballot corresponding to the image of ballot 205*a* can be quickly located for further examination or evaluation. In some embodiments, in response to a user selection (e.g., a mouse-click on the portion of the user interface window 260 coincident with the extracted vote target 240), an image of the ballot 205*a* is displayed.

Figure 3:
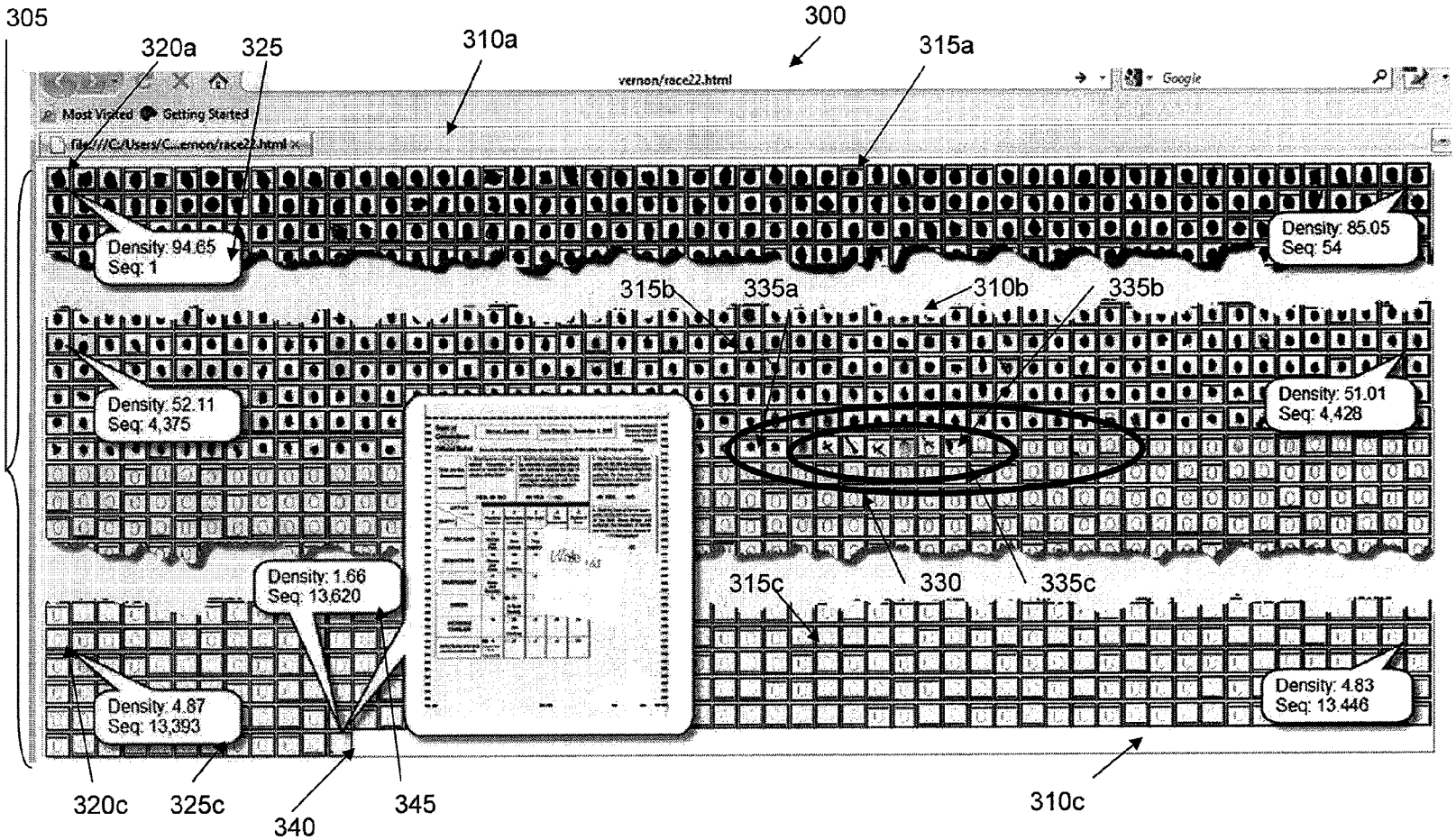
FIG. 3 is a screen capture of a user interface illustrating a partial set of displayed voter markings.

FIG. 3 is a screen capture of a user interface 300 illustrating a partial set 305 of displayed voter markings. The user interface 300 includes a first area 310*a*, a second area 310*b*, and a third area 310*c*. The first area 310*a* displays a plurality of images 315*a* of vote targets, e.g., as discussed above with respect to FIG. 2. The plurality of images 315*a* in the first area 310*a* (like the images 315*b* in the second area 310*b* and the images 315*c* in the third area 310*c*) are sorted in descending order by the score associated with each vote target. For example, as illustrated, the vote 320*a* is associated with a density value of 94.65 and is assigned a "Seq." number of 1, indicating vote 320*a* has the highest score. The information 325*a* associated with the vote 320*a* is displayed, for example, in response to hovering a mouse pointer over the part of the first area 310*a* collocated with the vote 320*a*.

The second area 310*b* displays a plurality of images 315*b* of vote targets. The second area 310*b* also includes a transition region 330. The transition region 330 illustrates the transition from markings 335*a* that indicate a voter's intent unambiguously and a vote target 335*b* that does not necessarily indicate voter intent. The transition region 330 typically appears around threshold density values. For example, in some embodiments, images of vote targets having a density above a particular threshold value are determined to be indications of voter intent to cast a vote (e.g., votes) and images of vote targets below the threshold value (or a second, usually lower threshold density value) are determined to be indications of voter intent to not cast a vote. Density values near these thresholds are typically associated with unclear markings or unclear indications of voter intent. For example, the vote targets 335*c* are not filled-in ovals, and therefore, may or may not be counted by a vote tabulator (not shown) according to the tabulator's logic. An advantage of the user interface 300 is quick and visual identification of votes in the transition region 335. By sorting the images 315*a*-315*c* in descending order according to the score, potentially problematic votes can be isolated and identified quickly. Moreover, because the images of the vote targets in the interface 300 are each associated with the physical location of a ballot, selection of a vote target (e.g., by hovering a mouse pointer over an image) provides information sufficient to locate the physical ballot quickly for manual inspection and/or determination of voter intent based on context and/or other markings on the ballot.

The third area 310*c* displays a plurality of images 315*c* of vote targets. The third area 310*c* typically displays vote targets that do not represent votes for a particular candidate or choice in an election. Like the images 315*a* and 315*b*, each of the images of vote targets 315*c* is associated with a density value or score and a Sequence identifier, identifying its relative position in the set of vote targets. For example, the vote target 320*c* is associated with a density of 4.87 and a Sequence No. of 13,393, shown in information 325*c*. The non-zero density value of vote target 320*c* is based in part on the image analysis tool including the pixels representing the oval or vote target in the density calculation. As discussed above, vote targets 315*c* having density scores below a threshold value are generally determined to be non-votes because non-votes typically have density values that fall below the threshold. The last vote target 340 in the third area 310*c* has a density score of 1.66 and a Sequence No. of 13,620, as shown in pop-up information 345. The information 345 quickly provides an indication of the number of ballots displayed for the election shown in the user interface 300. In this case, the user interface represents 13,620 total ballots. In general, the information 345 associated with the lowest-scoring vote target 340 should match the number of ballots counted by the vote tabulator.

Hovering a mouse over an area of the interface 300 quickly tells the user how many votes are in each area 310*a*-310*c*. Those of skill will appreciate that there are additional ways to communicate how many vote targets 315*a*-315*c* exist in each area 310*a*-310*c*. For example, the last vote in each area (e.g., the vote target with the lowest score above the applicable threshold) can be used to determine the number of votes in that area 310*a*-310*c*, e.g., by subtraction. Some embodiments feature the interface 300 providing information (not shown) indicating the summed or total number of votes in each area 310*a*-310*c*.

Figure 4:
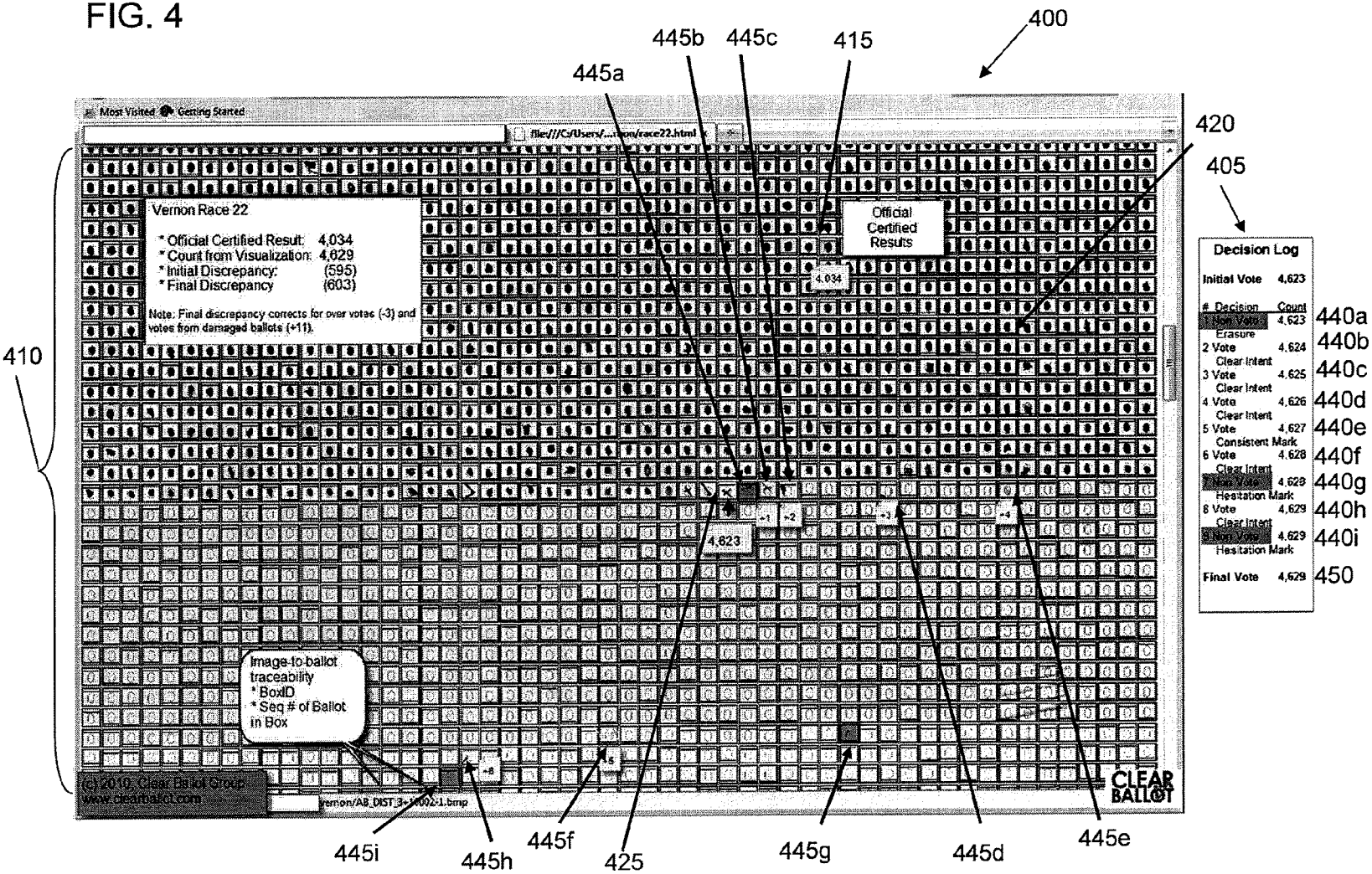
FIG. 4 is a screen capture of a user interface illustrating generation of a decision log.

FIG. 4 is a screen capture of a user interface 400 illustrating generation of a decision log 405. Additionally, the user interface 400 demonstrates the utility of quickly and simply visualizing areas for indication of voter intent as a way to verify and audit election results and is based on an actual audit of the 2008 General Election as certified by the Registrar of Voters in Vernon, Conn. The user interface 400 illustrates how the system 100 of FIG. 1 can assist an election department or an independent auditor in verifying the results of an election before the results are certified.

The interface 400 displays a plurality of images 410 of vote targets. The images 410 of vote targets are sorted in descending order according to the density value or score associated with each vote target. The interface 400 includes a vote target 415, at Sequence No. 4,304 in the set of images 410. The vote target 415 represents the total number of votes an election board certified for a particular candidate, in this case 4,034 votes (indicated as "Official Certified Results"). In this case, the number of votes, 4,034, was erroneous. As can be seen from the interface 400, however, the "Official Certified Results" appear to have missed a set 420 of additional votes intended for the particular candidate. The error of the Official Certified Results is almost immediately apparent based on the arrangement of vote targets 420 that appear after Sequence No. 4,034 and before the vote target 425 associated with Sequence No. 4,623. The image analysis tool (not shown) determined vote target 425 has the lowest density score above the threshold value of markings to be counted as votes. Thus, on initial inspection, there is a discrepancy of 589 votes between the certified results and the actual number of votes preliminarily identified.

The interface 400 also illustrates generation of the decision log 405. The decision log includes nine decision entries 440*a*-440*i*, each associated with a vote target 445*a*-445*i* in the set of vote targets 410. Each of the vote targets 445*a*-445*i* contains some type of marking that the vote tabulator did not record as an intended vote as shown by their appearance after vote target 425, Sequence No. 4,623, which is the last image having a density score above threshold. After manual inspection, vote targets 445*a*, 445*g*, and 445*i* were determined to not be votes. After the ballot image (not shown) associated with each of vote targets 445*a*, 445*g*, and 445*i* was selected (e.g., by a mouse-click on the vote targets 445*a*, 445*g*, and 445*i*) and the determination of "non-vote" was made, information associated with the reason for the determination was added to a field, either by user selection or free-text entry, was added or associated with the ballot. For example, vote target 445*a* was determined to be a non-vote whose marking was associated with an erasure, so the notation "Erasure" was added to the information field associated with the ballot. For vote targets 445*g* and 445*i*, the marking was determined to be a hesitation mark, not an indication of intent, and the notation "Hesitation Mark" was added to the information field associated with each ballot.

The information from the information field associated with the ballots is used to populate the decision log 405 (either automatically or in response to a user prompt or command to generate the decision log 405). For example, the determination of "Non Vote" and the indication of "Erasure" associated with the vote target 445*a* is shown as Entry No. 1 (440*a*) in the decision log 405. Similarly, the determination of "Non Vote" and the indication of "Hesitation Mark" associated with the vote targets 445*g* and 445*i* is shown, respectively, as Entry Nos. 7 (440*g*) and 9 on the decision log 405 (440*i*).

Moreover, the interface 400 can be used to change the status of a vote from non-vote to an affirmative or adjudicated vote. For example, each of the vote targets 445*b*-445*f* and 445*h*, upon examination of the ballot or ballot image associated with each vote target 445*b*-445*f* and 445*h*, was determined to constitute a vote based on clear intent. The information field associated with each respective ballot was updated or notated to indicate the determination of "Vote" and to indicate "Clear Intent" as the rationale for changing from non-vote to adjudicated vote. The information fields associated with each ballot was then used to populate the decision log 405. For example, the determination of "Vote" and the indication of "Clear Intent" associated with each of the vote targets 445*b*-445*f* and 445*h* is shown, respectively, as Entry Nos. 2-6 (decision entries 440*b*-440*f*) and Entry No. 8 (decision entry 440*h*). The decision log 405 provides an additional safeguard and record of decisions made by election officials in assessing the votes in the election. The order of the decision entries 440*a*-440*i* on the decision log 405 corresponds to the order (e.g., descending order according to score) the associated vote targets 445*a*-445*i* appear in the interface 400.

The decision log 405 includes a "Final Vote" field 450 that has a value of 4,629 to reflect the sum of adjudicated vote total associated with vote target 425 (e.g., 4,623) and the manually-determined votes added based on the decisions (e.g., 6 additional votes 445*b*-445*f* and 445*h*) reflected in the decision log 405. As a result of using interface 400, the correct number of votes for the candidate should have been 4,629, rather than the 4,034 votes certified as the election result. In this case, the certified results erroneously omitted 595 votes. The error was determined, after use of the visualization tools described here, to be the result of a manual error in transcribing the count of votes from a vote reader's poll tape to the official Head Moderator's Report that was filed with the Connecticut Secretary of State.

Figure 5:
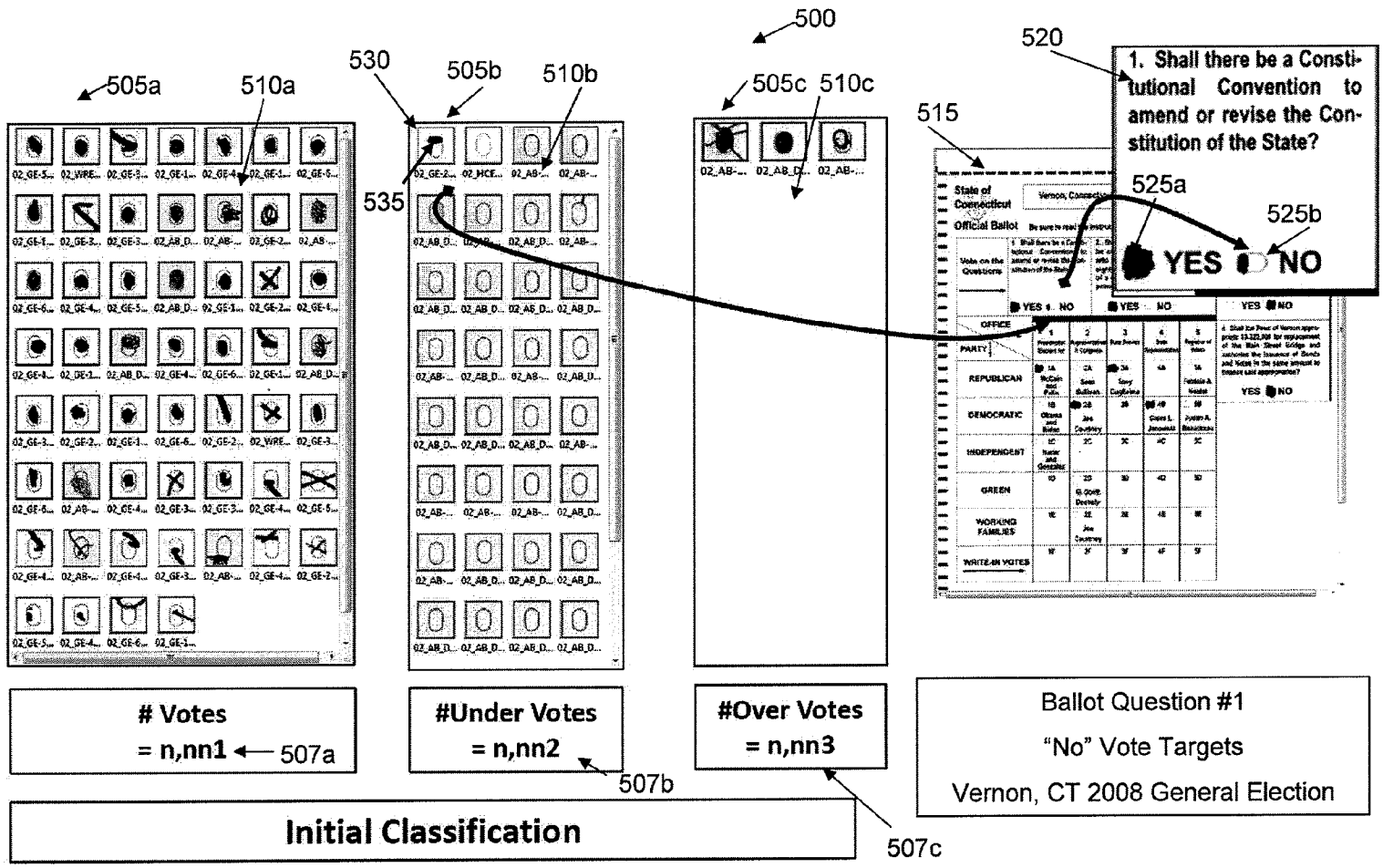
FIG. 5 is a screen capture of a user interface illustrating a set of voter markings subject to adjustment.

FIG. 5 is a screen capture of a user interface 500 illustrating a set of voter markings subject to adjustment. The user interface 500 includes a first portion 505*a* containing vote targets 510*a* of adjudicated votes, a second portion 505*b* containing vote targets 510*b* of under votes and a third portion 505*c* containing vote targets 510*c* of overvotes. In the illustrated embodiment, the vote targets 510*a*-510*c* are associated with the "No" choice in contest 520, titled "Ballot Question No. 1" on ballot 515. The contest 520 refers to "Ballot Question No. 1" is "Shall there be a Constitutional Convention to amend or revise the Constitution of the State?" and the voting rules associated with election require only one vote, either by filling the "Yes" oval 525*a* or the "No" oval 525*b*.

In general, the sum of the vote targets 510*a*-510*c* in each portion 505*a*-505*c* should be equal to the number of ballots visualized. The number of vote targets in each area 505*a*-505*c* is denoted, respectively, as "=n,nn1" 507*a*, "=n,nn2" 507*b*, and "=n,nn3" 507*c*. A decision process allows votes from one portion (e.g., vote targets 510*b* from the second portion 505*b*) to be moved to another portion (e.g., added to the vote targets 510*c* of the third portion 505*c*). For example, the second portion 505*b* contains a vote target 530 of interest. The vote target 530 is associated with ballot 515 and, specifically, contest 520. The marking 535 in the vote target 530 reflects the "No" oval 525*b* from contest 520 on the ballot 515 (rotated 90° counter-clockwise). In response to a user selection (e.g., hovering a mouse pointer over or clicking on vote target 530), the image of ballot 515 is displayed. Further examination reveals the "Yes" oval 525*a* completely filled and the "No" oval 525*b* only partially filled. Based on this examination and the voting rules or logic (e.g., only one vote for contest 520), the vote target 525*b* is ambiguous and might be adjudicated by a canvassing board either as an indication of voter intent, which would result in invalidating the "Yes" vote at 525*a* or, alternatively as a hesitation mark that did not indicate voter intent for the choice "No" and, therefore, recording the "Yes" vote at 525*a* as the voter's true intent. Although not illustrated, should the canvassing board ascribe voter intent to 525*b*, the rationale or explanation for moving vote target 530 from the second portion 505*b* to the third portion 505*c* can be added to an information field associated with the ballot 515 and used, if desired, to populate a decision log (not shown).

In some embodiments, the vote targets 510*a*-510*c* are categorized, grouped, or assigned to the respective portions 505*a*-505*c* based on a predetermined criterion (or criteria). Examples of such criteria include whether the density value of a particular vote target exceeds or falls below a predetermined threshold, whether a vote target falls between values associated with undervotes or overvotes, or some combination thereof to facilitate automated organization of vote targets into categories. A purpose of the grouping is to quickly organize potential votes, non-votes, and under-votes together and/or focus the attention of human judges on potentially ambiguous expressions of voter intent to significantly reduce the time needed to determine the vote count. In some embodiments, the vote targets 510*a*-510*c* in each portion 505*a*-505*c* are sorted according to their score (e.g., a density score), but this is not required.

Figure 6:
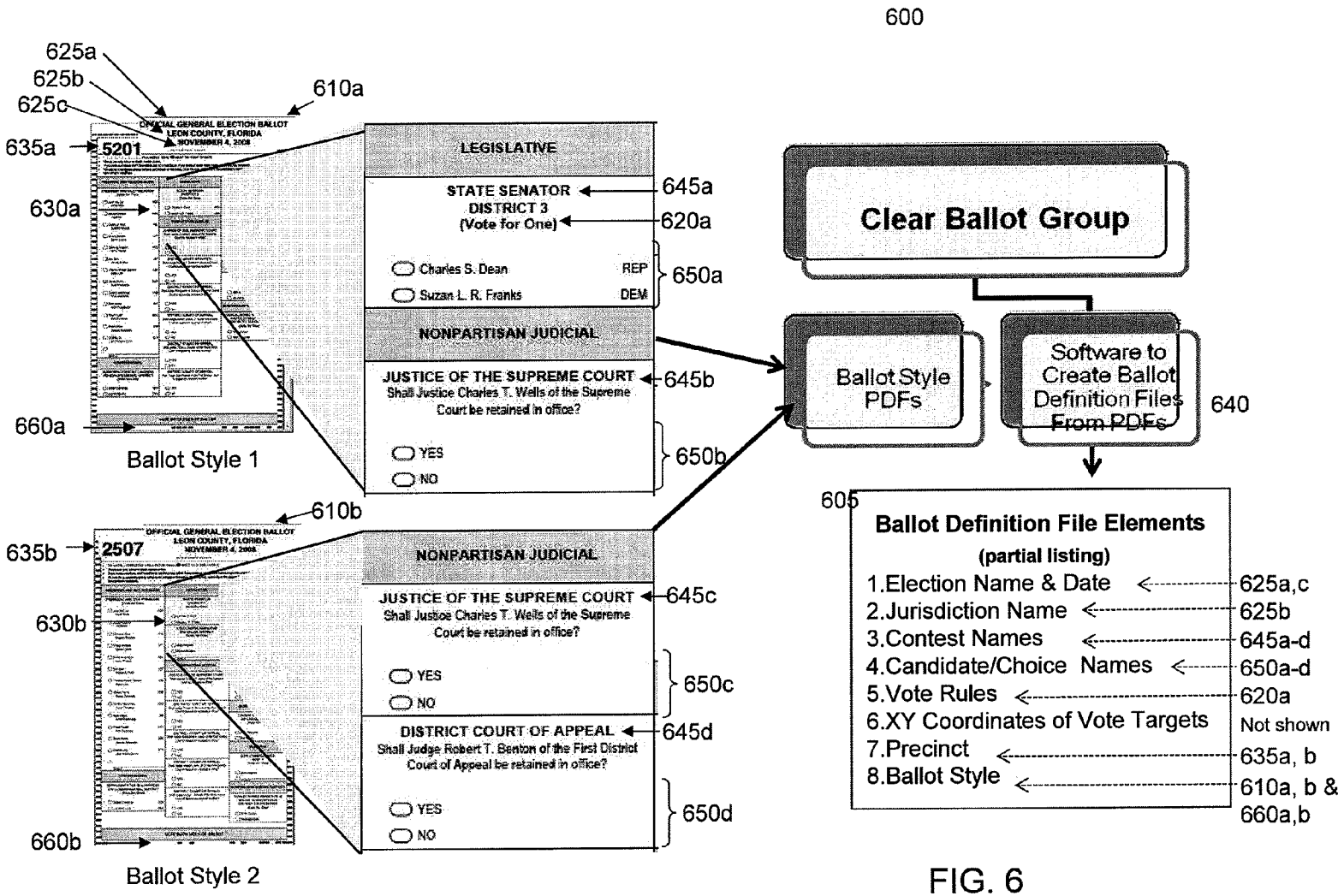
FIG. 6 is a conceptual block diagram of a system for generating a ballot definition file from a ballot.

FIG. 6 is a conceptual block diagram of a system 600 for generating a ballot definition file 605 from a ballot 610*a* or a ballot 610*b*. The system 600 allows testing of a voting system prior to Election Day with a set of pre-marked test ballots having a known result and that correspond to the voting system's memory card ballot style configuration and independently auditing and election outcome with a validated ballot definition file. For some jurisdictions, there are hundreds or thousands of ballot styles, each unique depending on the combination of contests and the choice positions presented thereon. Due to the variability in ballot styles, it can be difficult, costly, and time-consuming to consistently hand-mark a unique ballot style for testing purposes.

The ballot 610*a* is associated with a first ballot style, and the ballot 610*b* is associated with a second ballot style. In general, a ballot style refers to the combination and placement of races and the order of choices in an election. In some embodiments, the combination and placement of races and choices is unique. For example, the ballot 610*a* includes a location 635*a* that contains a Contest 645*a* for "State Senator District 3" and a Contest 645*b* for "Justice of the Supreme Court". The ballot 610*b* also includes a corresponding location 635*b* that depicts a different set of Contests 645*c* and 645*d*.

The system 600 receives as input the ballot style of ballot 610*a* and of ballot 610*b*. In some embodiments, the ballots 610*a*-610*b* are received as ballot images and the ballot style is extracted and associated with an identifier. For example, the ballot images for ballots 610*a*-610*b* can be received as PDF files. The ballot style information can be used to print physical (e.g., paper) ballots for the purpose of facilitating marking of the ballots (e.g., as part of conducting an election and/or for validating the ballot definition file 605).

The system 600 includes a module 640 that generates the ballot definition 605 based on the received ballot style information associated with each of the ballots 610*a*-610*b*. In some embodiments, the module 640 includes an image-analysis tool that analyzes, with a computing device, the ballots 610*a*-610*b* to generate the ballot definition file 605. For example, the image-analysis tool can determine, based on image analysis, the elements of the ballot style associated with each ballot type 610*a*-610*b*.

The ballot definition file 605 can include a variety of information about the ballots 610*a*-610*b*. For example, the ballot definition file 605 can include the elements set forth in the table below, with reference to the location 615*a* of ballot 610*a*:

| Element | Description | Example | Reference |
|---|---|---|---|
| Jurisdiction | The territorial extent to which an election applies | Leon County, Florida | 625b |
| Election & Date | The name of the election and the date on which the election was conducted | "General Election"<br>Nov. 4, 2008 | 625a<br>625c |
| Contest Name(s) | The electoral contest(s) within an election | "State Senator"<br>"Justice of the Supreme Court" | 645a-d |
| Candidate/Choice Name(s) | The names of the candidates/choices running in each contest 645a. In location 615a, the candidate names are "Charles S. Dean" and "Suzan L. R. Franks" | "Charles S. Dean"<br>"Suzan L. R. Franks"<br>"Yes"<br>"No" | 650a<br>650b, c, d |
| Vote Rules | Information codifying the number of votes a voter may cast in a contest. | "Vote for One" | 620a |
| XY Coordinates of Vote Targets | The x- and y- coordinates for each vote target 645d associated with the contest relative to a reference coordinate system. The coordinates can be represented, in some embodiments, as pixel coordinates. | 13, 2 | Not shown |
| Precinct/District | A geographic subset of the election jurisdiction. | "5201"<br>"2507" | 635a<br>635b |
| Ballot Style Number | A numeric identifier that is typically encoded into a machine-readable dash-code or barcode. This identifier tells the vote reader which interpretation to use for this ballot. | Not human readable. In this embodiment, the dashes along the bottom of the ballot encode the Ballot Style number. | 660a, b |

The elements of the ballot definition file 605 can be stored in any format suitable for allowing ballots to be printed, machine-marked, and/or for tabulating votes. The various uses for the generated ballot definition file 605 are discussed in more detail below.

Figure 7:
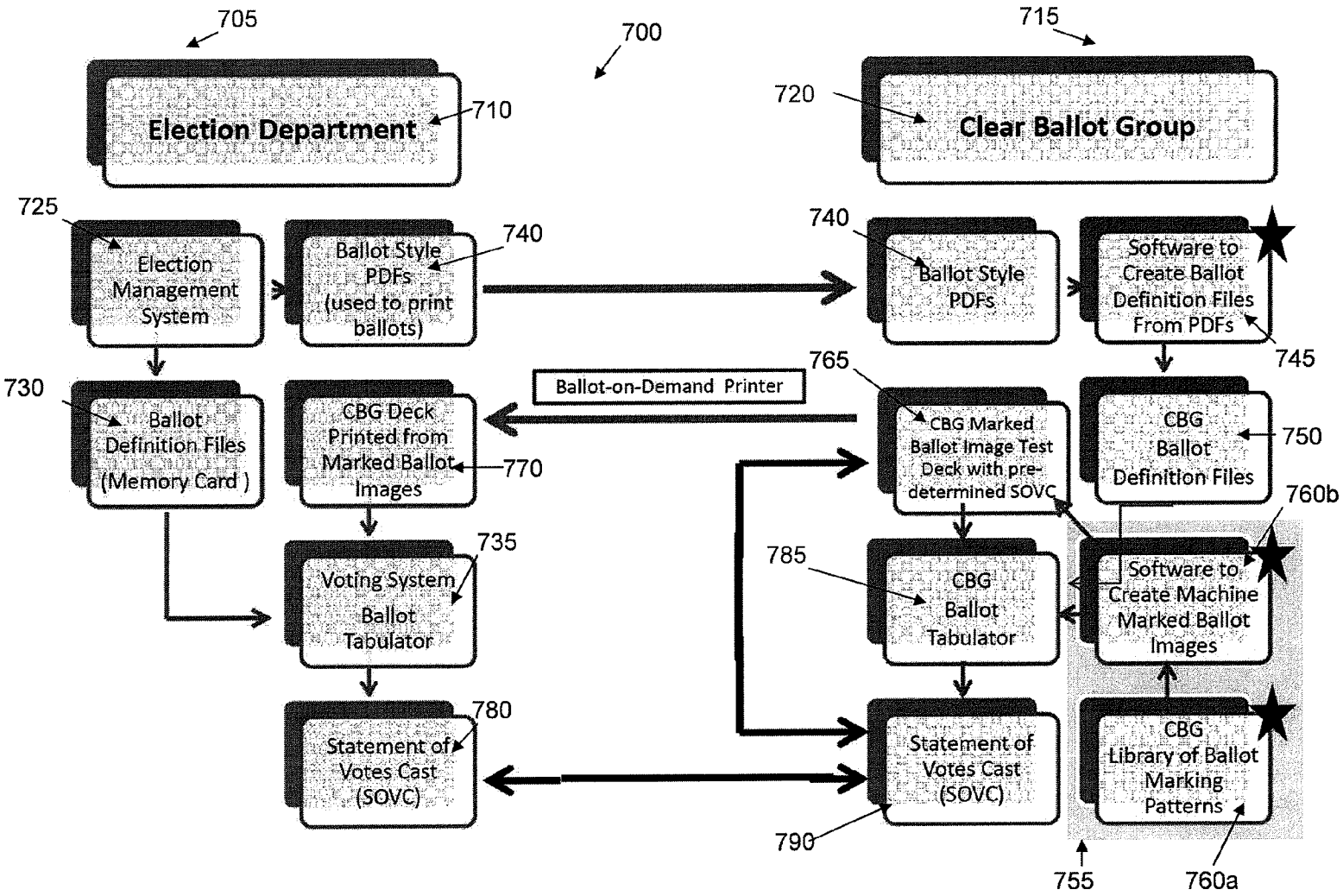
FIG. 7 is a block diagram of a system for validating a ballot definition file.

FIG. 7 is a conceptual block diagram of a system 700 for validating a ballot definition file 750. The system 700 includes a first portion 705 typically performed by an election department 710 and a second portion 715 typically performed by an entity 720 seeking to validate and/or audit an election such as, for example, Clear Ballot Group of Boston, Mass. (or its customers) or an election watchdog.

The first portion 705 includes an election management system 725 that is used to administer an election. In one embodiment, the election management system 725 is used to create a set 730 of ballot definition files that are used to program the vote tabulators. For example, the set 730 of ballot definition files can be stored on one or more memory cards (not shown) and provided to a set of scanners and/or vote tabulators 735 for interpreting and/or counting marked ballots. The election management system 725 is also associated with a set 740 of ballot styles (e.g., saved as PDF files). The set 740 of ballot styles can be used, for example, to print ballots for conducting the election. As illustrated, the set 740 of ballot styles is provided the entity 720. The entity 720 can use the set 740 of ballot styles as an input to a module 745 for generating a set 750 of one or more ballot definition files, based on the set 740 of ballot styles. The set 750 of ballot definition files is created and validated independently of the set 730 of ballot definition files used by the election department 710. In some embodiments, each of the set 750 of ballot definition files corresponds to at least one member of the set 730 of ballot definition files. The validation of the files in the set 750 typically proceeds on a file-by-file basis, but this is not required.

The set 750 of ballot definition files can be provided to a ballot-marking module 755 that includes a database 760*a* of marking patterns and an implementation module 760*b* that prepares or generates a set 765 of marked ballots corresponding to the applicable marking patterns for a simulated election. The set 765 of marked ballots can either be ballot images corresponding to the simulated election or physical ballots prepared based on ballot images. The set 765 of marked ballots is based on the database 760*a* of marking patterns reflecting the applicable voting logic or rules and a predicted or controlled election outcome. As illustrated, the set 765 of marked-ballots is represented as a set of ballot images that can be converted into machine-marked paper ballots 770 by a ballot-on-demand printer 775 printing the set 765 on ballot-stock paper. In some embodiments, the marking module 755 marks the ballots with varying darkness gradations to simulate actual election conditions. Moreover, the module 755 can simulate voter-marked ballots (e.g., using an "X" shape instead of a darkened oval). Moreover, the marking module 755 can implement over-votes, blank votes, undervotes, or combinations of valid votes, based on the voting pattern and/or a voting rule or voting rule logic.

The process for validating the set 750 of ballot definition files involves processing a set of machine-generated ballot images 765 with a second vote tabulator 785. The machine-generated ballot images 765 were created by using the set of ballot definition files 750 and a pre-determined pattern of marking the ballots 760*a*. The ballot images have a predetermined Statement of Votes Cast 765 ("SOVC"). Validating the internal consistency of the set 750 of ballot definition files involves comparing the SOVC 765 to SOVC 790, the output of the independent vote tabulator 785 as calculated by the entity 720.

The process to ensure that the voting system 705 and the audit system 715 are capable of producing identical results involves validating the set 750 of ballot definition files against the set 730 memory card versions of the ballot definition files by counting the votes from a set of marked paper ballots 770 using the tabulator 735 of the election department 710 to produce a Statement of Votes Cast 780 ("SOVC 780"). In some embodiments, the ballots in 770 can be printed on ballot stock by a "ballot-on-demand printer" or, in another embodiment, marked by hand by using the images from 765 as a template. Typically, the election department 710 performs this step. SOVC 780 is calculated based on the election department's equipment (e.g., scanners and vote tabulator 735) and the election department's ballot definition file 730 to determine a simulated election outcome based on readings or analysis of the machine-marked paper ballots 770. Provided the markings are well formed, the results from 780 should exactly match the result from 790.

The comparison of SOVC 780 and SOVC 790 results in a comparison value (not shown). If the comparison value exceeds a predetermined threshold (e.g., 95%), the set 750 of ballot definition files is deemed to acceptably represent (e.g., as a proxy for) the set 730 of ballot definition files the election department 710 uses to conduct an actual election on a file-by-file basis or one-to-one correspondence. To calculate the comparison value, each member of a set (not shown) of match points from SOVC 780 is compared to a corresponding match point from SOVC 790. In some embodiments, a match point from either SOVC 780 or SOVC 790 includes certain information such as, for example, a vote count associated with a choice, a precinct, and/or a voter group.

Additionally, the SOVC 790 can be compared to information associated with the set 765 of marked ballots. The set 765 of marked ballots represents the output of the marking module 755 and, ideally, the information associated with the set 765 should be equal to the information determined in the SOVC 790 by tabulating the set 765 of ballots. In such a configuration, this process provides a quality check internal to the entity 720. If either the comparison between SOVC 790 and SOVC 780 or the information associated with the set 765 of marked ballots falls below an acceptable threshold, the set 750 of ballot definition files is deemed to not adequately or accurately represent the set 730 of ballot definition files. The ballot definition file from the set 750 can be evaluated, and the validation process can then be performed again, possibly with changed parameters of the image analysis device/tool or the generation module 745 that creates the ballot definition file.

Figure 8:
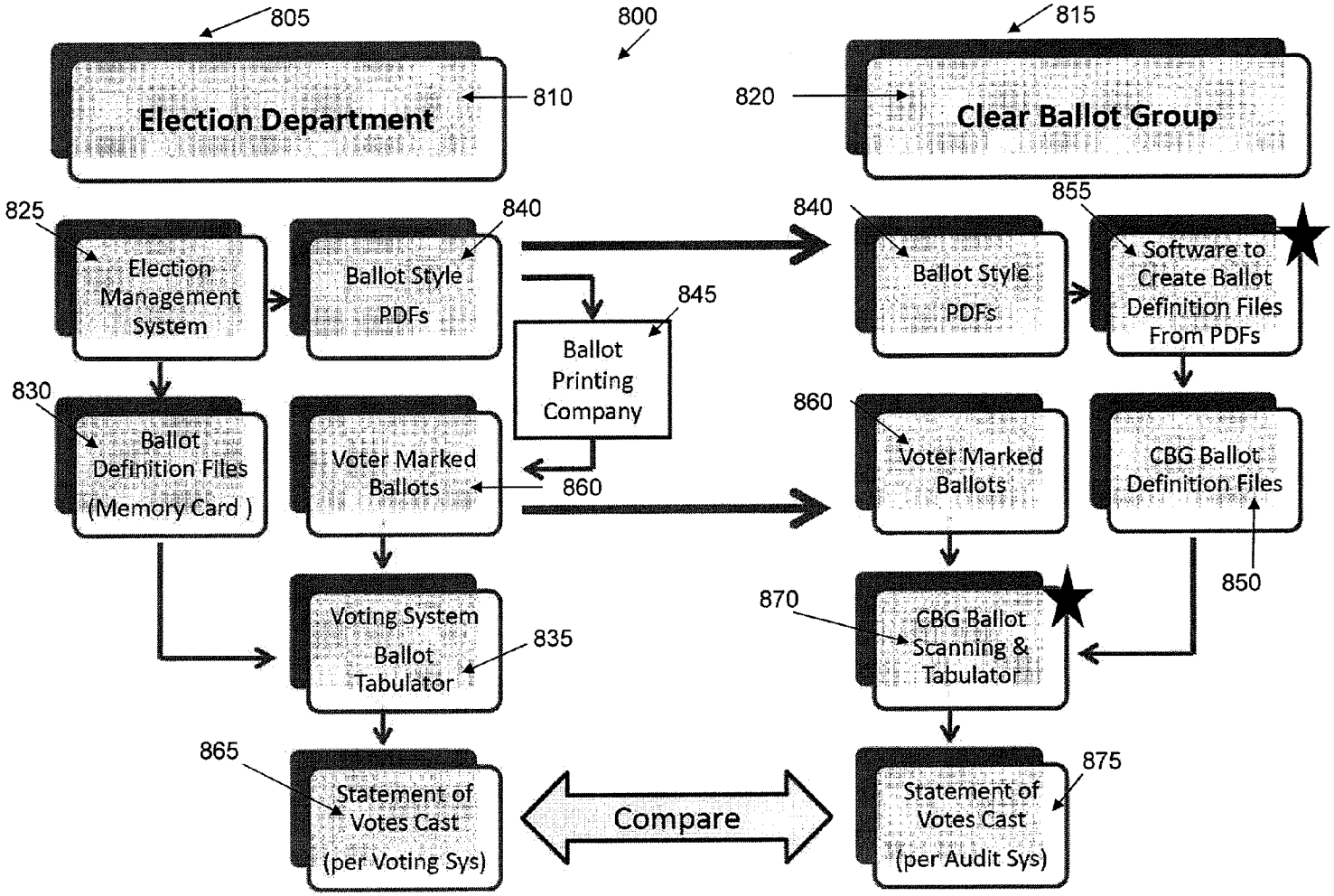
FIG. 8 is a block diagram of a system for auditing an election with a validated ballot definition file.

FIG. 8 is a conceptual block diagram of a system 800 for auditing an election with a validated ballot definition file 850. The system 800 includes a first portion 805 typically performed by an election department 810 and a second portion 815 typically performed by an entity 820 seeking to audit an election result such as, for example, Clear Ballot Group of Boston, Mass. (or its customers) or an election watch-dog.

The first portion 805 of FIG. 8 is conceptually similar to the first portion 705 of FIG. 7 in that the first portion 805 includes an election management system 825 associated with a set 830 of ballot definition files used to administer the election. The set 830 of ballot definition files can be stored on one or more memory cards (not shown) and provide to a set of scanners and/or vote tabulators 835 for interpreting and/or counting marked ballots 860. A set 840 of ballot styles is used by a ballot printing element 845 to generate blank ballots (not shown) on which voters will mark their intent to create a collection 860 of voter-marked ballots. Like FIG. 7, a set of ballot styles 840 is provided to the entity 820 for generation and validation of a set 850 of ballot definition files by a module 855 as described with respect to FIG. 7. The collection 860 of voter-marked ballots is processed by the tabulator 835 of the election department 810 to determine a Statement of Votes Cast 865 ("SOVC 865"). The SOVC 865 represents the initial determination of the results of the elections on the collection 860 of voter-marked ballots and is referred to as the initial actual election outcome.

To facilitate auditing the election, the collection 860 of voter-marked ballots (e.g., either ballot images or paper ballots that are converted to ballot images) is provided to the system supplied by entity 820. The collection 860 of voter-marked ballots is then processed by a vote tabulator 870 associated with the entity 820. The vote tabulator 870 processes the voter-marked ballots 860 using the validated ballot definition file 850 associated with the particular ballot style 840 represented by the voter-marked ballots 860. In some embodiments, the vote tabulator 870 determines the particular ballot definition file from the set 850 based on a preliminary analysis of the voter-marked ballots. The vote tabulator 870 provides as output a Statement of Votes Cast 875 ("SOVC 875") based on the vote tabulator's 870 processing of the voter-marked ballots and the ballot definition file 850. The SOVC 875 is, in some embodiments, referred to as a predicted election outcome.

Auditing an election involves comparing the SOVC 865 that the vote tabulator 835 of the election department 810 produces and the SOVC 875 that the vote tabulator 870 of the entity 820 produces. The comparison of SOVC 865 and SOVC 875 results in a comparison value (not shown). The comparison value is generally directly proportional to the confidence in the election outcome represented by SOVC 865. More specifically, if the independently-generated ballot definition file 850, which was previously validated, used to process the collection 860 of voter marked ballots produces a SOVC 875 that is dramatically different than SOVC 865, the entity 820 (or others) may have reason to question or challenge whether the actual election outcome reflects actual voter intent or the correct number of votes. Conversely, if the SOVC 875 closely matches the SOVC 865, the degree of confidence increases.

To calculate the comparison value, each member of a set (not shown) of match points from SOVC 865 is compared to a corresponding match point from SOVC 875. In some embodiments, a match point from either SOVC 865 or SOVC 875 includes certain information such as, for example, a vote count associated with a choice, a precinct, and/or a voter group. If there are discrepancies in the match-points between SOVC 865 and SOVC 875, the individual ballots giving rise to the discrepancies can be quickly obtained and visualized using, for example, the visualization tools described and shown in FIGS. 1-5. This allows election monitors and/or auditors to quickly isolate and diagnose discrepancies and facilitate faster, less expensive, and more efficient recounts of the election outcome if necessary.

Figure 9:
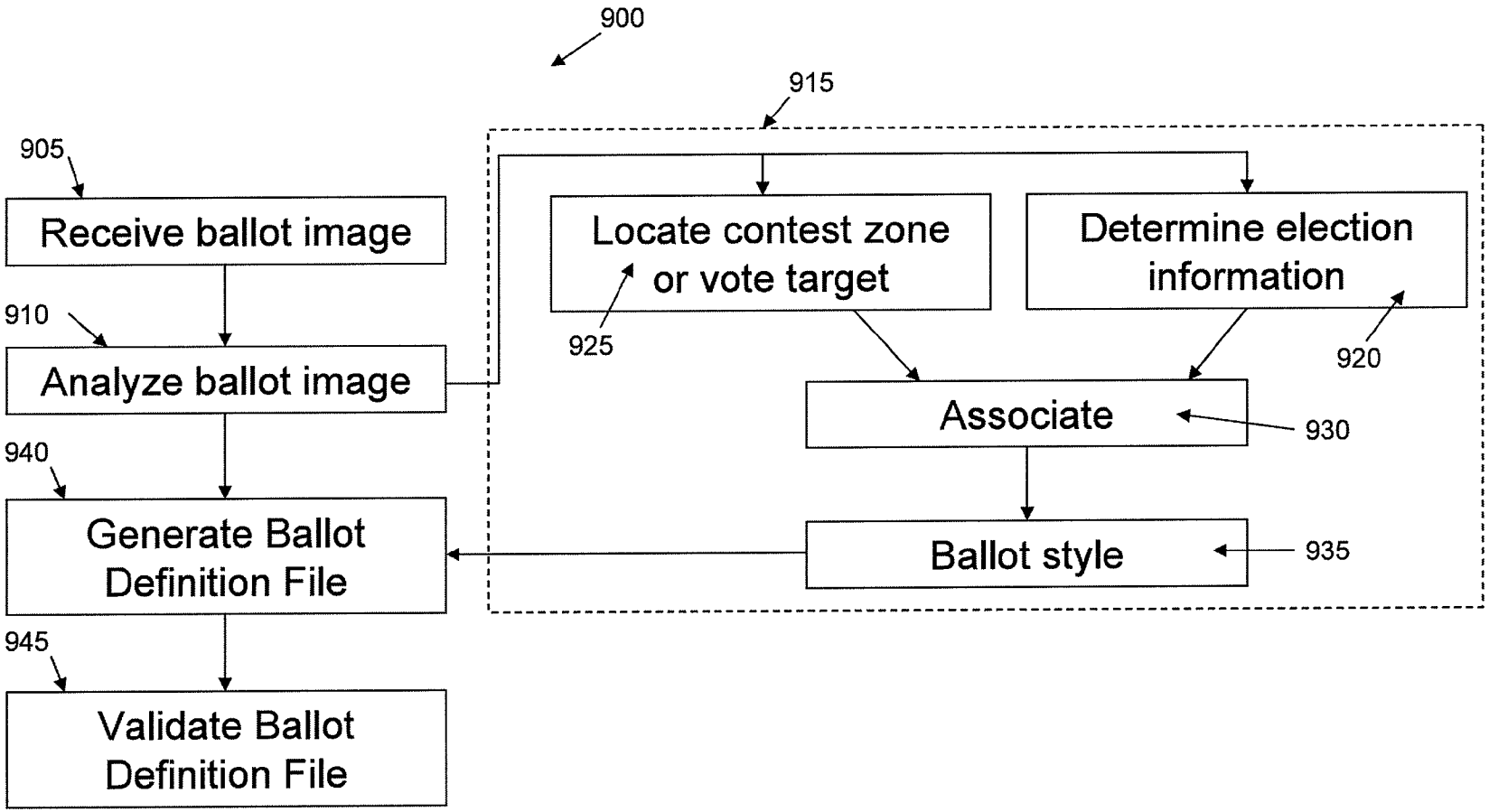
FIG. 9 is a flow chart of an exemplary process for generating a ballot definition file.

FIG. 9 is a flow chart 900 of an exemplary process for generating a ballot definition file. The flow chart 900 illustrates a process that can be executed or carried out by, for example, the module 745 of FIG. 7 or the module 855 of FIG. 8. Moreover, the flow chart 900 represents a simplified form of the process, and additional details or information from a ballot can be analyzed and/or determined from a particular ballot image for storing in a ballot definition file.

The process involves receiving a ballot image (step 905) that is associated with a particular ballot style. As discussed above, a ballot style is a combination and placement of races and choices in an election on a particular date. The ballot image is analyzed (step 910) to extract and process information. The ballot image can be analyzed by an image-processing tool designed to read and extract information from the ballot image. An exemplary sub-routine 915 is depicted for extracting information from the ballot image. The image analysis tool determines election information (step 920) and locates a contest zone and/or vote target on the ballot image (step 925). Exemplary election information includes the jurisdiction represented by the ballot style, the election identity and date, the contest name, the candidate names, the voting rules associated with the contest, and/or the precinct. The contest zone includes, for example, the region on a ballot image in which certain election information is located or positioned. For example, the election identity, contest name, candidate names, and voting rules can be located in or near the contest zone. The x-y coordinates, relative to a reference frame, of the vote targets is also determined. In some embodiments, the x-y coordinates are indexed by timing marks appearing along an edge or edges of the ballot image, but this is not required.

After the information has been extracted by the image analysis tool in steps 920-925, the extracted information is associated (step 930) to define a ballot style (step 935). Analysis of the ballot image (step 910) and/or sub-routine 915 results in generation of a ballot definition file (step 940). After the ballot definition file is generated, the ballot definition file is validated (step 945), for example, using the process described with respect to FIGS. 7 and 10.

Figure 10:
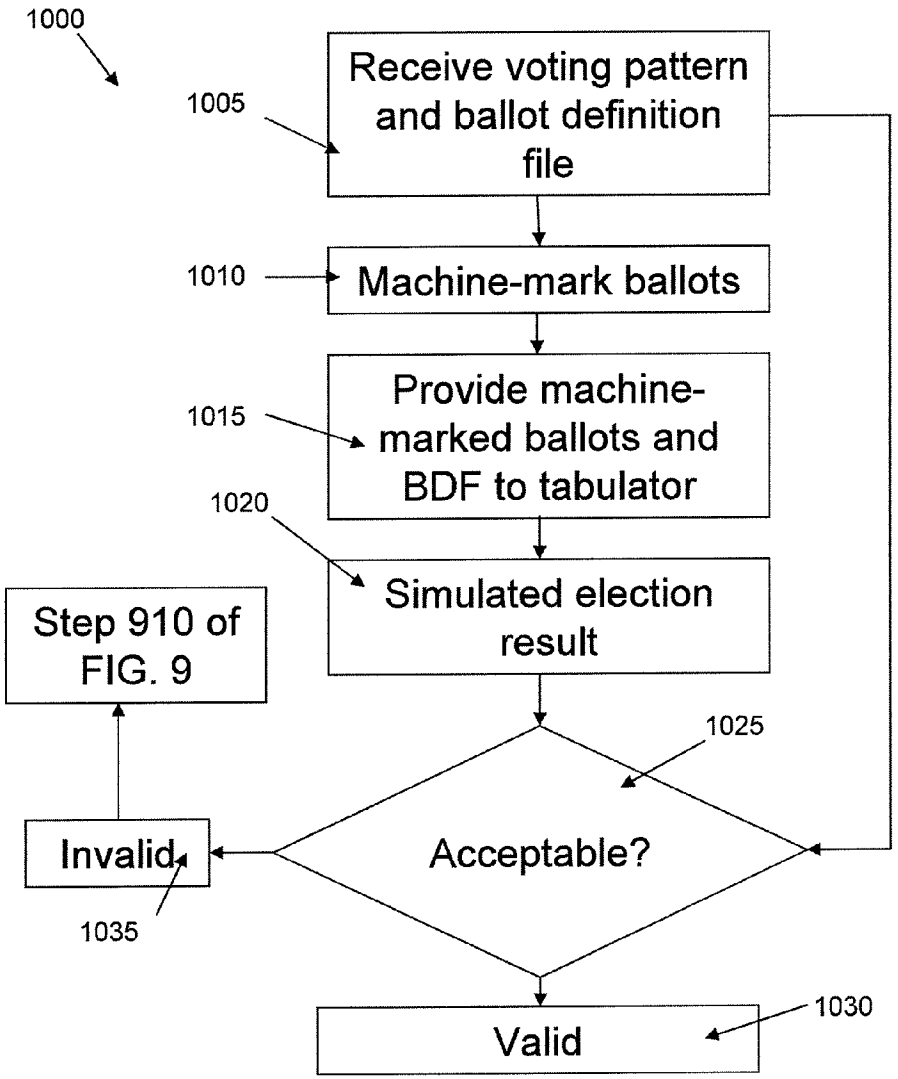
FIG. 10 is a flow chart of an exemplary process for validating a ballot definition file.

FIG. 10 is a flow chart 1000 of an exemplary process for validating a ballot definition file. The flow chart 1000 can depict, for example, the validation step (step 945) of FIG. 9. The process involves receiving a voting pattern and ballot definition file (step 1005). The voting pattern provides an expected outcome of one or more elections. The voting pattern can include, for example, the number of votes for each candidate in a simulated election. For example, the voting pattern can specify that Candidate A will receive 15 votes and Candidate B will receive 25 votes as the election outcome. In some embodiments, the voting pattern specifies how each ballot should be machine-marked such that the combination of machine-marked ballots results in Candidate A receiving 15 votes and Candidate B receiving 25 votes. Where a ballot contains more than one election, the number of possible voting pattern combinations increases. The ballot definition file received at this step 1005 is a ballot definition file generated from a ballot image independently of the ballot definition file an election department actually uses the conduct the election. Moreover, the received ballot definition file is the ballot definition file being validated.

The validation process involves machine-marking the ballots according to the voting pattern and based on the ballot definition file (step 1010). For example, machine marking the ballots involves evaluating the voting pattern, in conjunction with the ballot definition file, to determine how the ballots are to be marked to satisfy the voting pattern and then marking the ballots to satisfy the voting pattern. In some embodiments, the location of marks representing expressions of voter intent corresponds to the x-y coordinate of the vote target information for the candidate who is to receive the vote. The x-y coordinate of the vote target is specified in the ballot definition file. A marking is made over the vote target location based on the logic specified in the voting pattern. The process involves providing the set of machine-marked ballots (either paper ballots or ballot images) and the ballot definition file being validated to a vote tabulator (step 1015).

The vote tabulator scans and tabulates a simulated election result by evaluating the machine-marked ballots using the ballot definition file to provide a simulated election outcome (step 1020). In some embodiments, the simulated election outcome is in the form of a Statement of Votes Cast generated by the vote tabulator. The simulated election outcome from step 1020 is compared with the voting pattern information from step 1005, also called a predicted election outcome, in step 1025. In some embodiments, the predicted election outcome is in the form of a Statement of Votes Cast. If the predicted election outcome and the simulated election outcome acceptably match (step 1025) according to an acceptability criterion or threshold, the ballot definition file is deemed to validly represent the ballot definition file the election department will use to conduct the election (step 1030). If the predicted election outcome and the simulated election outcome do not acceptably match in step 1025, the ballot definition file is deemed to not validly represent the election department's ballot definition file (step 1035), and the process returns to step 910 of FIG. 9 for regeneration of a new ballot definition file (e.g., based on changed or updated parameters to the image analysis tool or module generating the ballot definition file).

Figure 11:
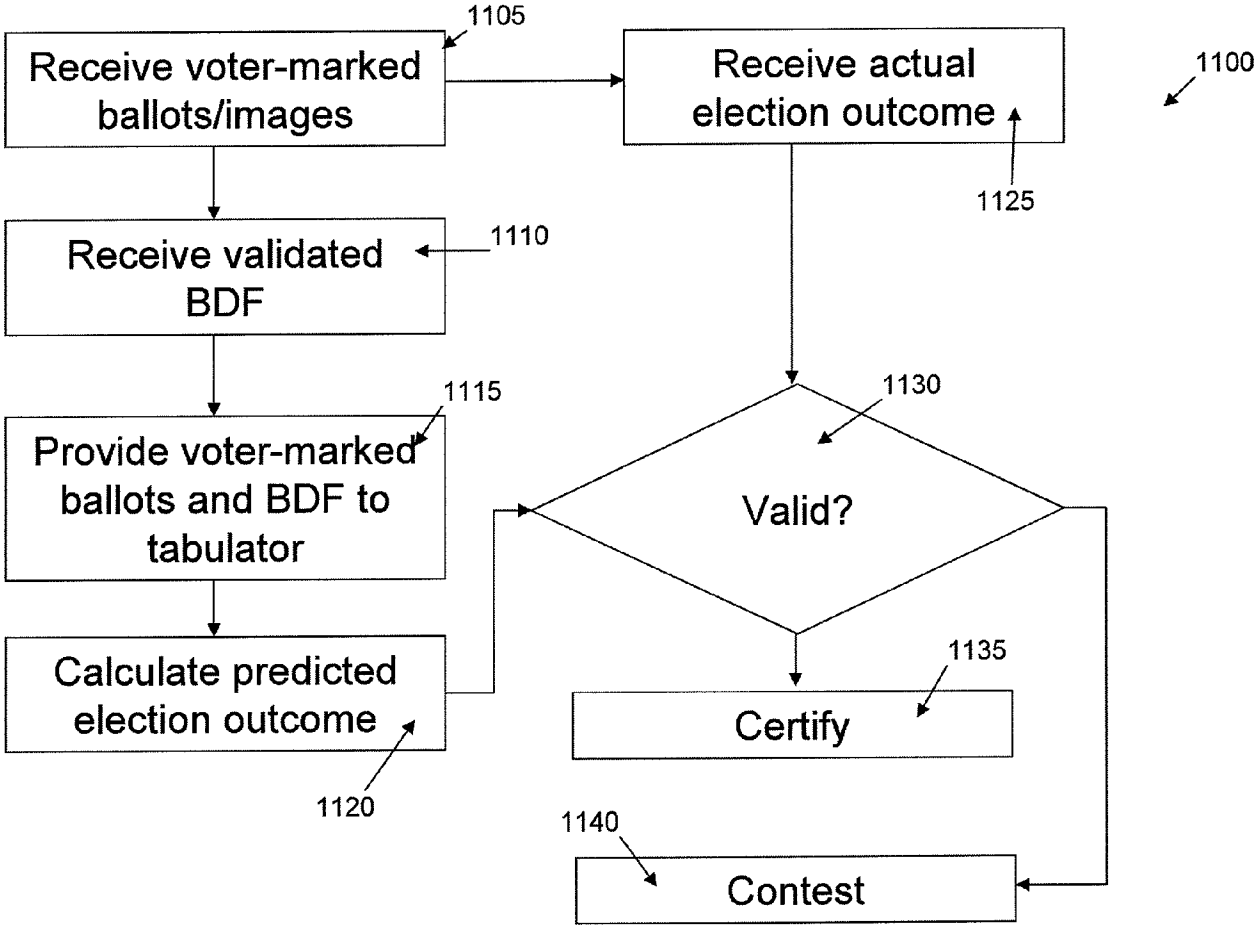
FIG. 11 is a flow chart of an exemplary process for auditing an election.

FIG. 11 is a flow chart 1100 of an exemplary process for auditing an election. The process involves receiving a set of voter-marked ballots (step 1105). The voter-marked ballots can be either ballot images or physical ballots. In embodiments in which the voter-marked ballots are physical ballots, the process involves converting the physical ballots to ballot images (not shown). An exemplary format for the ballot images is either JPG or PDF format. The process involves receiving a validated ballot definition file (step 1110), for example, a ballot definition file generated by the process of FIG. 9 and validated by the process of FIG. 10. The validated ballot definition file is created independently of knowledge of the underlying ballot definition file of the election department and is based on an image of a ballot or ballot style. The process involves providing the voter-marked ballot images and the validated ballot definition file to a vote tabulator (step 1115). The vote tabulator examines and evaluates the voter-marked ballots using the validated ballot definition file to produce a predicted election outcome (step 1120). The predicted election outcome of step 1120 differs from the predicted election outcome discussed with respect to FIG. 10. The result of the predicted election outcome in FIG. 11 generally is not known in advance because the voter-marked ballots are generated by voters each potentially expressing intent differently or by different and imperfect marking styles on physical ballots and because the ballots are not machine-marked according to a predetermined voting pattern to desirably produce the expected or predicted result.

The process involves receiving an actual election outcome (step 1125). The actual election outcome is typically provided by an election department administering an election. In some embodiments, the actual election outcome of step 1125 takes the form of a Statement of Votes Cast, as determined by the election department's vote tabulator (e.g. 865 in FIG. 8). The actual election outcome of step 1125 is compared to the predicted election outcome of step 1120 in a comparison or determination process (step 1130). If the comparison results in an acceptable match (e.g., both the actual election outcome and the predicted election outcome indicate a candidate received the same number of votes), the election can be certified or approved (step 1135). If, on the other hand, the comparison of step 1130 results in a non-acceptable match, the election can be contested or further investigation into the discrepancy conducted (step 1140). For example, if the predicted election outcome calculates 100 votes for Candidate A but the actual election outcome calculates 95 votes for Candidate A, the 5-vote discrepancy can be investigated (e.g., using the visualization tools of FIGS. 1-5).

In some embodiments, the comparison of step 1130 is performed by comparing "match points" from the actual election outcome and the predicted election outcome. Discrepancies or mismatches in match points can give rise to discrepancies between the outcomes, and such discrepancies can be used to pinpoint ballots to be further investigated to determine voter intent or tabulator mis-reads.

The above-described techniques can be implemented in digital electronic circuitry, or in computer hardware, firmware, software, or in combinations of them. The implementation can be as a computer program product, e.g., a computer program tangibly embodied in an information carrier, e.g., in a machine-readable storage device, for execution by, or to control the operation of, data processing apparatus, e.g., a programmable processor, a computer, or multiple computers. A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a communication network.

Method steps can be performed by one or more programmable processors executing a computer program to perform functions of the technology by operating on input data and generating output. Method steps can also be performed by, and apparatus can be implemented as, special purpose logic circuitry, e.g., an FPGA (field programmable gate array) or an ASIC (application-specific integrated circuit). Modules can refer to portions of the computer program and/or the processor/special circuitry that implements that functionality.

Processors suitable for the execution of a computer program include, by way of example, both general and special purpose microprocessors, and any one or more processors of any kind of digital computer. Generally, a processor receives instructions and data from a read-only memory or a random access memory or both. The essential elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. Data transmission and instructions can also occur over a communications network. Information carriers suitable for embodying computer program instructions and data include all forms of non-volatile memory, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in special purpose logic circuitry.

The terms "module" and "function," as used herein, mean, but are not limited to, a software or hardware component which performs certain tasks. A module may advantageously be configured to reside on addressable storage medium and configured to execute on one or more processors. A module may be fully or partially implemented with a general purpose integrated circuit ("IC"), FPGA, or ASIC. Thus, a module may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables. The functionality provided for in the components and modules may be combined into fewer components and modules or further separated into additional components and modules. Additionally, the components and modules may advantageously be implemented on many different platforms, including computers, computer servers, data communications infrastructure equipment such as application-enabled switches or routers, or telecommunications infrastructure equipment, such as public or private telephone switches or private branch exchanges ("PBX"). In any of these cases, implementation may be achieved either by writing applications that are native to the chosen platform, or by interfacing the platform to one or more external application engines.

To provide for interaction with a user, the above described techniques can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer (e.g., interact with a user interface element). Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

The above described techniques can be implemented in a distributed computing system that includes a back-end component, e.g., as a data server, and/or a middleware component, e.g., an application server, and/or a front-end component, e.g., a client computer having a graphical user interface and/or a Web browser through which a user can interact with an example implementation, or any combination of such back-end, middleware, or front-end components. The components of the system can be interconnected by any form or medium of digital data communications, e.g., a communications network. Examples of communications networks, also referred to as communications channels, include a local area network ("LAN") and a wide area network ("WAN"), e.g., the Internet, and include both wired and wireless networks. In some examples, communications networks can feature virtual networks or sub-networks such as a virtual local area network ("VLAN"). Unless clearly indicated otherwise, communications networks can also include all or a portion of the PSTN, for example, a portion owned by a specific carrier.

The computing system can include clients and servers. A client and server are generally remote from each other and typically interact through a communications network. The relationship of client and server arises by virtue of computer programs running on the respective computers and having a client-server relationship to each other.

Various embodiments are depicted as in communication or connected by one or more communication paths. A communication path is not limited to a particular medium of transferring data. Information can be transmitted over a communication path using electrical, optical, acoustical, physical, thermal signals, or any combination thereof. A communication path can include multiple communication channels, for example, multiplexed channels of the same or varying capacities for data flow.

Multiple user inputs can be used to configure parameters of the depicted user interface features. Examples of such inputs include buttons, radio buttons, icons, check boxes, combo boxes, menus, text boxes, tooltips, toggle switches, buttons, scroll bars, toolbars, status bars, windows, or other suitable icons or widgets associated with user interfaces for allowing a user to communicate with and/or provide data to any of the modules or systems described herein.

While the invention has been particularly shown and described with reference to specific embodiments, it should be understood by those skilled in the art that various changes in form and detail may be made therein without departing from the spirit and scope of the invention as defined by the appended claims.

While the invention has been particularly shown and described with reference to specific embodiments, it should be understood by those skilled in the art that various changes in form and detail may be made therein without departing from the spirit and scope of the invention as defined by the appended claims.

What is claimed is:

1. A method for displaying information associated with a set of ballots including one or more areas for expression of intent, the method comprising analyzing, with a computerized image analysis tool, the areas for expression of intent on the set of ballots, the image analysis tool providing a score associated with the areas for expression of intent for one or more of the set of ballots;

sorting and arranging the analyzed areas for expression of intent according to a predetermined criterion; and displaying the arranged analyzed areas on an image-display device according to the predetermined criterion.

2. The method of claim 1, further comprising:

associating an area for expression of intent with a ballot on which the area appears;

in response to selection of at least one of the displayed areas, displaying the ballot associated with the selected area.

3. The method of claim 1, wherein the set of ballots comprises paper ballots or computerized images of paper ballots.

4. The method of claim 3, further comprising associating a location of a physical ballot with the corresponding image of the ballot; and displaying the location of the physical ballot.

5. The method of claim 3, further comprising:

generating the computerized images based on a corresponding set of paper ballots.

6. The method of claim 1, wherein the one or more areas for expression of intent include a marking indicative of potential voter intent.

7. The method of claim 1 wherein the analyzed areas are an actual marking or a proxy marking

8. The method of claim 1, wherein the predetermined criterion is associated with the score.

9. The method of claim 8, wherein the score is based on a density of a marking in an area for expression of intent.

10. The method of claim 1, wherein the predetermined criterion is associated with a characteristic of an election.

11. The method of claim 10, wherein the characteristic comprises at least one of a voter group, a race, a choice, a box-ID, a precinct, a district, or any combination thereof.

12. The method of claim 1, wherein the predetermined criterion is associated with a characteristic of a vote comprising at least one of an adjudicated vote, a marginal vote, an undervote, an overvote, an indication of uncaptured voter intent, a non-vote, or any combination thereof

13. The method of claim 12, wherein displaying further comprises grouping the one or more areas based on the characteristic of the vote or ballot associated with the respective one or more areas.

14. The method of claim 13, further comprising sorting the grouped areas.

15. The method of claim 1, wherein displaying further comprises sorting the one or more areas into one or more categories based on the score for each area.

16. The method of claim 15, further comprising determining the number of areas in each category.

17. The method of claim 13, wherein grouping further comprises determining whether a marking in an area constitutes a vote.

18. The method of claim 1, further comprising determining whether a marking in an area for expression of intent constitutes a vote.

19. The method of claim 1, further comprising obscuring or not displaying a race associated with the area for expression of intent.

20. The method of claim 1, wherein the area for expression of intent comprises at least one of a vote target or a contest zone.

21. The method of claim 1, further comprising providing an interface associated with an area for expression of intent, the interface configured to receive user-supplied information.

22. The method of claim 21, wherein the interface comprises at least one of a user-fillable field or a set of user-selectable choices, or both.

23. The method of claim 21, further comprising updating a characteristic associated with the area based on the user-supplied information.

24. The method of claim 23, wherein the user-supplied information comprises at least one of a decision affecting the characteristic, a reason for the decision, or both.

25. The method of claim 24, further comprising:

generating a decision log based on the user-supplied information, the decision log comprising at least one of a ballot number associated with the area, the decision, the reason, a number of ballots associated with the decision, a number of ballots associated with the reason, or any combination thereof

26. The method of claim 25, further comprising displaying the decision log.

27. A computer program product, tangibly embodied in a non-transitory computer-readable storage medium, containing instructions operable to cause data processing apparatus to:

receive a set of ballots, each of the ballots including one or more areas for expression of intent;

analyze, with a computerized image analysis tool, the areas for expression of intent on the set of the ballots, the image analysis tool providing a score associated with the areas for expression of intent for one or more of the set of ballots;

sort and arrange the analyzed areas for expression of intent according to a predetermined criterion; and display the arranged analyzed areas on an image-display device according to the predetermined criterion.

28. A computerized system for facilitating auditing an election, the system comprising:

a user interface in communication with a data processor;

the data processor comprising:

means for analyzing one or more areas for expression of intent on a received set of ballots, the image analysis module providing a score associated with the areas for expression of intent for one or more of the set of ballots;

means for sorting and arranging the analyzed areas for expression of intent according to a predetermined criterion;

an interface in communication with the sorting module operable to communicate the arranged analyzed areas to a display device for display according to the predetermined criterion.

* * * * *

UNITED STATES PATENT AND TRADEMARK OFFICE

CERTIFICATE OF CORRECTION

PATENT NO. : 8,523,052 B2
APPLICATION NO. : 13/116874
DATED : September 3, 2013
INVENTOR(S) : Larry Moore It is certified that error appears in the above-identified patent and that said Letters Patent is hereby corrected as shown below:

Title Page: Item 73

Assignee: after "Clear Ballot Group" add --, Inc.--

Signed and Sealed this
Twenty-eighth Day of January, 2014

Michelle K. Lee

Michelle K. Lee
*Deputy Director of the United States Patent and Trademark Office*